US007500854B2

(12) United States Patent
Gottstein

(10) Patent No.: US 7,500,854 B2
(45) Date of Patent: Mar. 10, 2009

(54) ELECTRICAL POWER DISTRIBUTION APPARATUS HAVING A ROTATABLE SOCKET

(76) Inventor: M. Peter Gottstein, 1814 W. Henderson, Chicago, IL (US) 60657

( * ) Notice: Subject to any disclaimer, the term of this patent is extended or adjusted under 35 U.S.C. 154(b) by 0 days.

(21) Appl. No.: 11/265,349

(22) Filed: Nov. 2, 2005

(65) Prior Publication Data

US 2007/0099458 A1 May 3, 2007

(51) Int. Cl.
*H01R 39/00* (2006.01)

(52) U.S. Cl. ..... 439/13; 439/21

(58) Field of Classification Search ..... 439/13, 439/21, 22, 27

See application file for complete search history.

(56) References Cited

U.S. PATENT DOCUMENTS

| | | | | |
|---|---|---|---|---|
| 2,093,358 | A | 9/1937 | Holler | |
| 2,225,461 | A | 12/1940 | Reynolds | |
| 2,383,109 | A | 8/1945 | Conlan | |
| 2,704,831 | A | 3/1955 | Smith | |
| 2,735,079 | A | 2/1956 | Passarelli | |
| 2,872,654 | A | 2/1959 | Smith | |
| 3,136,592 | A | 6/1964 | Miller | |
| 3,407,376 | A | 10/1968 | Martin | |
| 5,035,635 | A | 7/1991 | Tsai | |
| 5,236,371 | A * | 8/1993 | Matthis | 439/501 |
| 5,399,093 | A * | 3/1995 | Schneider et al. | 439/21 |
| 5,429,518 | A * | 7/1995 | Chen | 439/188 |
| 5,484,299 | A | 1/1996 | Schlessinger | |
| 5,703,324 | A | 12/1997 | Harder | |
| 5,775,921 | A * | 7/1998 | Chou | 439/21 |
| 5,795,168 | A | 8/1998 | Duhe | |
| 5,902,140 | A | 5/1999 | Cheung et al. | 439/139 |
| 5,928,000 | A | 7/1999 | Rudisill | |
| 5,957,701 | A * | 9/1999 | McMillin | 439/13 |
| 5,967,815 | A | 10/1999 | Schlessinger | |
| 6,015,307 | A * | 1/2000 | Chiu et al. | 439/139 |
| 6,068,490 | A * | 5/2000 | Salzberg | 439/25 |
| 6,079,995 | A | 6/2000 | Duhe | |
| 6,196,851 | B1 * | 3/2001 | Gerard et al. | 439/21 |
| 6,302,743 | B1 * | 10/2001 | Chiu et al. | 439/652 |

(Continued)

FOREIGN PATENT DOCUMENTS

EP 464451 B1 8/1991

OTHER PUBLICATIONS

360 Electrical LLC, 360 Electrical, Found on Nov. 17, 2005, Four page internet website.

(Continued)

*Primary Examiner*—Hae Moon Hyeon

(57) ABSTRACT

The Improved electrical power distribution apparatus is an invention that because of its unique rotatable live female electrical connection type outlets, is able to accommodate the simultaneous insertion of male type electrical connection plugs of a wide variety and shape. The accommodation of such simultaneous insertion of such male type electrical connection plugs provides for the simultaneous powering of a wide variety of appliances wherein such appliances would not otherwise be able to be simultaneously powered by conventional power distribution apparatuses due to the inability of such male type electrical connection plugs of irregular size and shape to be simultaneously inserted into conventional non-rotatable female electrical connection type outlets of conventional power distribution apparatuses. Furthermore, the female electrical connection type outlets of the present invention may be rotated while having male type electrical connection plugs inserted therein, and yet still maintain an electrical connection.

18 Claims, 5 Drawing Sheets

U.S. PATENT DOCUMENTS

| | | | | |
|---|---|---|---|---|
| 6,638,074 | B1 * | 10/2003 | Fisher | 439/22 |
| 6,750,410 | B2 * | 6/2004 | Lee | 200/51.03 |
| 2001/0018277 | A1 | 8/2001 | Gerard et al. | 439/13 |
| 2006/0110946 | A1 | 5/2006 | Gerard | |
| 2006/0110947 | A1 * | 5/2006 | Gerard | 439/21 |
| 2006/0110948 | A1 | 5/2006 | Gerard | |

OTHER PUBLICATIONS

Popular Science, 360 Electrical Duplex Outlet, Found on Nov. 17, 2005, One page internet article.

Usernomics, 360 Electrical Socket, Found on Nov. 17, 2005, One page internet article.

Patrick Haney, 360 Electrical, Found on Nov. 17, 2005, One page internet article.

Gear Live, 360 Electrical's Rotating Outlet, Found on Nov. 17, 2005, One page internet advertisement.

* cited by examiner

ELECTRICAL POWER DISTRIBUTION APPARATUS HAVING A ROTATABLE SOCKET

BACKGROUND OF THE INVENTION

The present invention relates to electrical power distribution devices. More particularly, the present invention relates to electrical power distribution devices that can be plugged into a standard wall electrical outlet and provide further multiple electrical outlets into which electricity using devices may be plugged.

SUMMARY OF THE INVENTION

The present invention is an improved electrical power distribution apparatus. The invention, having rotatable female type electrical connection outlets or devices, has particular application for use in connecting multiple electricity using appliances, wherein the male plug type electrical connecting member of such appliances would not otherwise simultaneously be connectable in a conventional electrical power distribution apparatus, due to the size and geometry of such male plug type electrical connecting members.

It is well know that electrical connection outlets have long existed. Some samples of such electrical outlets include the common female two outlet wall mounted electrical connection apparatus in widespread use in the US and other countries, and the so-called "power strip" type electrical connection apparatus which typically includes some type of generally rigid housing having a plurality of female type electrical connection outlets, and an extension cord member including a male type electrical connection plug connected to the first end of the cord, and the second end of the cord being electrically connected to the plurality of female type electrical connection outlets. However, such conventional electrical connection outlets typically employ female type electrical connection outlets that are rigidly fixed to a housing and are not rotatable.

At least one example of a "power strip" having rotatable female type electrical connection outlets is know and is disclosed in U.S. Pat. No. 5,902,140 by Cheung et. al. U.S. Pat. No. 5,902,140 is expressly incorporated herein by reference. However, the electrical connection apparatus of '140, in contrast to the subject invention, does not provide for electrical connection unless the female type electrical connection outlets are in a certain spring-loaded predetermined rotated orientation and only in the certain spring-loaded predetermined rotated orientation. The '140 patent is intended to provide a safety apparatus that prevents children from inserting foreign objects into the female type electrical connection outlets, when the female type electrical connection outlets are in a nominal or non-rotated orientation.

It is further known that the differences in size and geometry of male type electrical connection plugs has proliferated in recent years. This is due in part to the additional functions that have been added to such male type electrical connection plugs. For instance, many male type electrical connection plugs incorporate an electrical power transformer as an integral portion of the male type electrical connection plug. Such transforming function can cause the male type electrical connection plug to take on a large overall cubic shape. Thus for instance, it is not uncommon to encounter a physical interference between two such power transforming male type electrical connection plugs, due to the size and shape of such power transforming male type electrical connection plugs and due to the spacing of conventional or non-rotating female type electrical connection outlets.

Because the subject invention provides rotatable female type electrical connection outlets that maintain electrical connectability regardless of the rotational orientation of the female type electrical connection outlets, the subject invention provides for simultaneous electrical connection of such otherwise non-simultaneously connectable male type electrical connection plugs by means of arranging the female type electrical connection outlets of the subject invention in a more connection friendly or physically non-interfering rotational orientation.

DESCRIPTION OF DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which:

FIG. 1 includes a display of the top, front, and side surfaces of the improved electrical power distribution apparatus.

FIG. 2 includes a display of the bottom, front, and right side surfaces of the improved electrical power distribution apparatus.

DETAILED DESCRIPTION OF THE INVENTION

Figure 1:
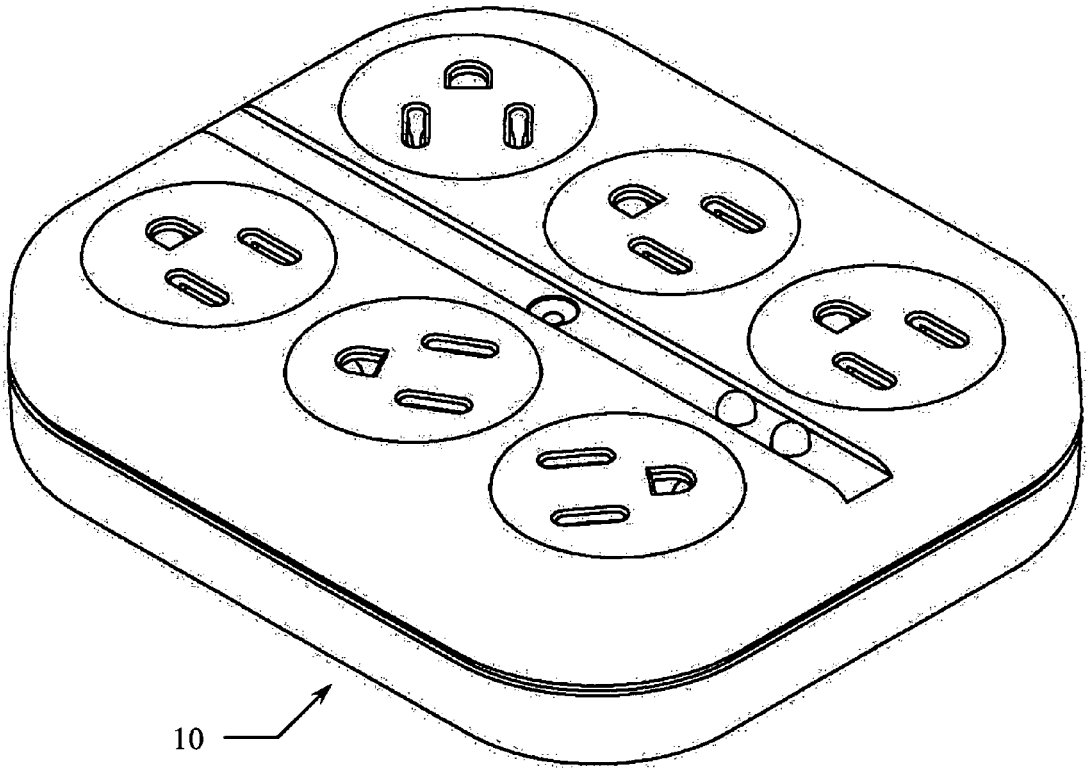
FIG. 1 is a substantially isometric view of the improved electrical power distribution apparatus. The female type electrical connection outlets of the improved electrical power distribution apparatus are shown in various random rotational orientations.
Figure 2:
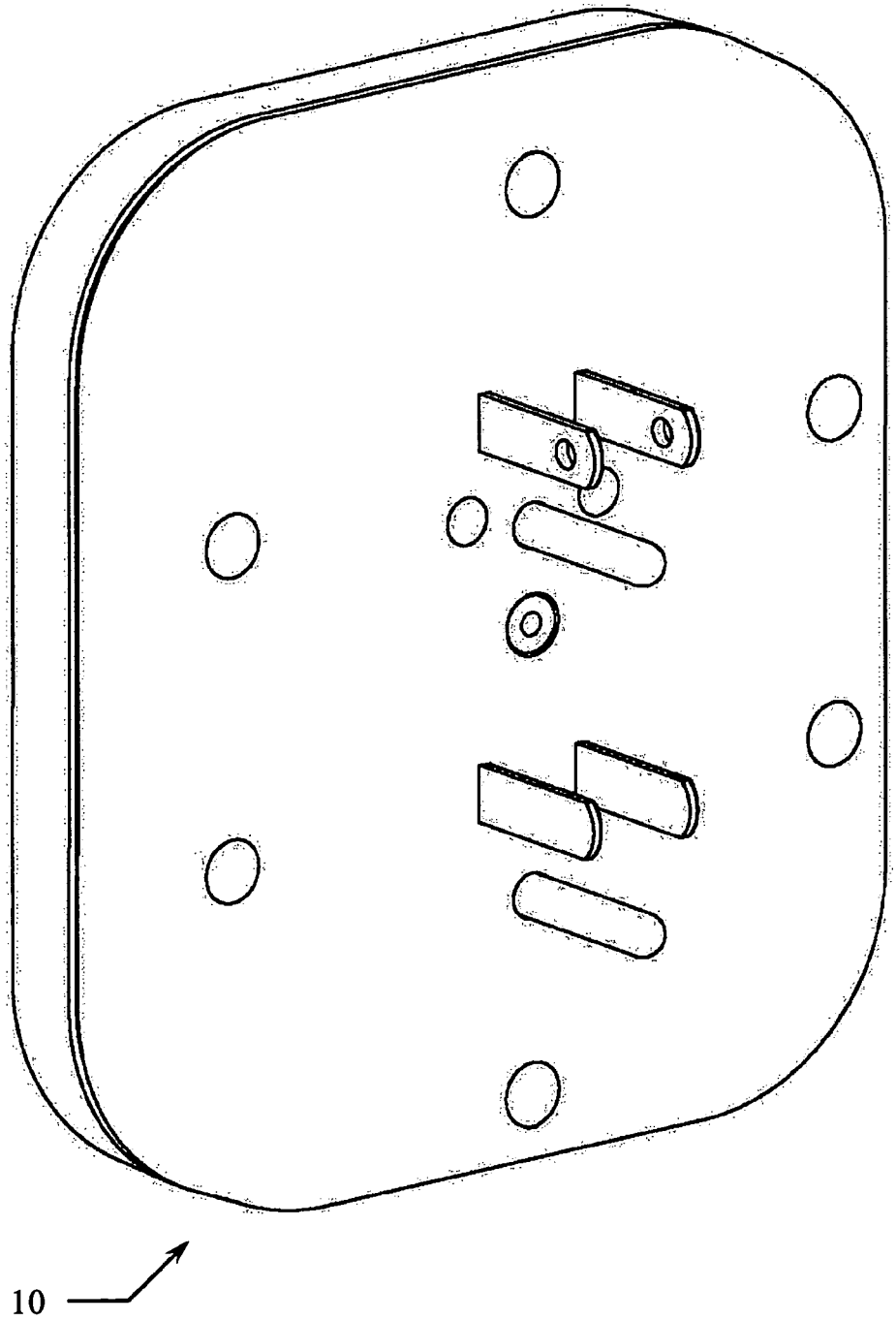
FIG. 2 is a substantially isometric view of the improved electrical power distribution apparatus. The improved electrical power distribution apparatus is depicted in an orientation such that the improved electrical power distribution apparatus is rotated downward approximately 90 degrees from the orientation shown in FIG. 1. It is noted that such downward rotation defines a rotation about a theoretical axis defined by the intersection of the planes defined by the improved electrical power distribution apparatus top and right side substantially planer surfaces.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are included to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

In order to facilitate the understanding of the present invention in reviewing the drawings accompanying the specification, a feature table is provided below. It is noted that like features are like numbered throughout all of the figures.

FEATURE TABLE

| # | Feature |
|---|---|
| 10 | Electrical power distribution apparatus in general |
| 20 | Upper housing |
| 21 | Upper housing interface recess |
| 22 | Upper housing female electrical connection device opening |
| 23 | Upper housing non-conductive male plug retention flange |
| 24 | Upper housing recessed channel |
| 25 | Upper housing indication light opening |
| 26 | Upper housing fastener post |
| 30 | Lower housing |
| 31 | Lower housing interface flange |
| 32 | Lower housing electrical power supply prong opening |
| 33 | Lower housing electrical power return prong opening |
| 34 | Lower housing strap retention flange |
| 35 | Lower housing fastener post |
| 36 | Lower housing fastener post reception recess |
| 37 | Lower housing electrical ground prong opening |
| 40 | Female electrical connection device |
| 41 | Female electrical connection body |
| 42 | Female electrical connection device power supply connection cavity |
| 43 | Female electrical connection device power return connection cavity |
| 44 | Female electrical connection device ground connection cavity |
| 50 | Female electrical connection device power supply bracket |
| 51 | Female electrical connection device power supply bracket upper connection surface |
| 52 | Female electrical connection device power supply bracket lower connection surface |
| 54 | Female electrical connection device power return bracket |
| 55 | Female electrical connection device power return bracket upper connection surface |
| 56 | Female electrical connection device power return bracket lower connection surface |
| 60 | Female electrical connection device ground bracket |
| 61 | Female electrical connection device ground bracket upper connection surface |
| 62 | Female electrical connection device ground bracket lower connection surface |
| 70 | Power supply strap assembly |
| 71 | Power supply strap |
| 72 | Power supply strap connection ring |
| 73 | Power supply strap connection ring interface surface |
| 74 | Power supply strap connection bar |
| 75 | Power supply strap prong |
| 76 | Power supply strap prong interface surface |
| 80 | Power return strap assembly |
| 81 | Power return strap |
| 82 | Power return strap connection ring |
| 83 | Power return strap connection ring interface surface |
| 84 | Power return strap connection bar |
| 85 | Power return strap prong |
| 86 | Power return strap prong interface surface |
| 90 | Ground strap |
| 91 | Ground strap connection pad |
| 92 | Ground strap connection pad interface surface |
| 93 | Ground strap connection bar |
| 94 | Ground strap connection prong |
| 95 | Ground strap connection prong interface surface |
| 96 | Ground strap mounting flange |
| 97 | Ground strap mounting flange hole |
| 98 | Ground strap ground prong passage hole |
| 100 | Non-conductive male connection plug |
| 101 | Non-conductive male connection plug base |
| 102 | Non-conductive male connection plug seating flange |
| 103 | Non-conductive male connection plug simulated power supply prong |
| 104 | Non-conductive male connection plug simulated power return prong |
| 105 | Non-conductive male connection plug simulated ground prong |
| 110 | Indication light |
| 112 | Partial opening |
| 114 | Partial opening |

Figure 5:
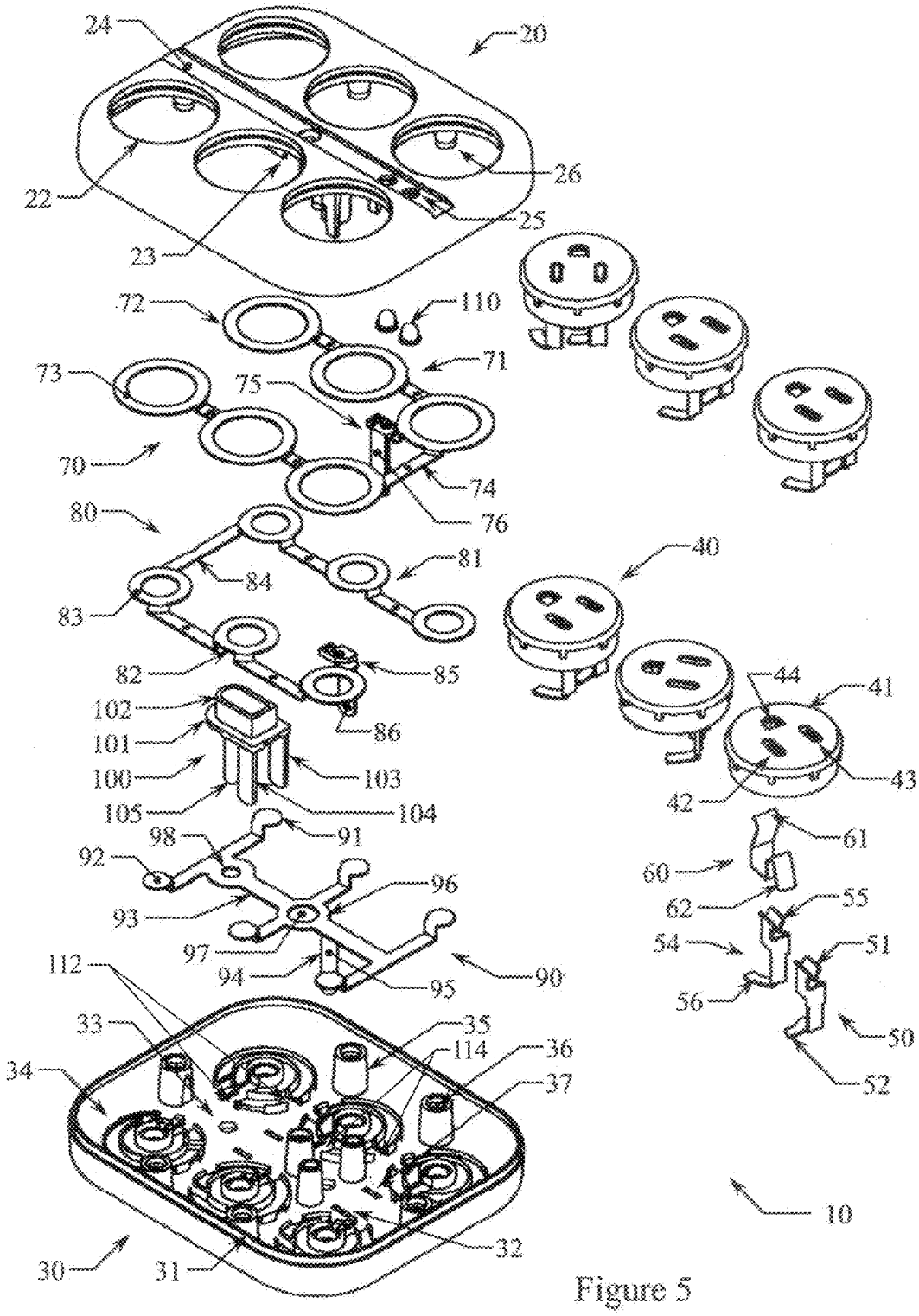
FIG. 5 is a substantially exploded isometric view of the improved electrical power distribution apparatus.

Referring now to the drawings and particularly to FIG. 5, the invention is improved electrical power distribution apparatus 10 comprising an upper housing 20 a lower housing 30, a plurality of female electrical connection devices 40, a power supply strap assembly 70, a power return strap assembly 80, a ground strap 90, a non-conductive male connection plug 100, and a plurality of indication lights 110. Female electrical connection device 40 comprises the assembly of a body 41, a bracket 50, a bracket 54, and a bracket 60. Power supply strap assembly 70 comprises the assembly of a power supply strap 71 and a prong 75. Power return strap assembly 80 comprises the assembly of a power return strap 81 and a prong 85.

Figure 3:
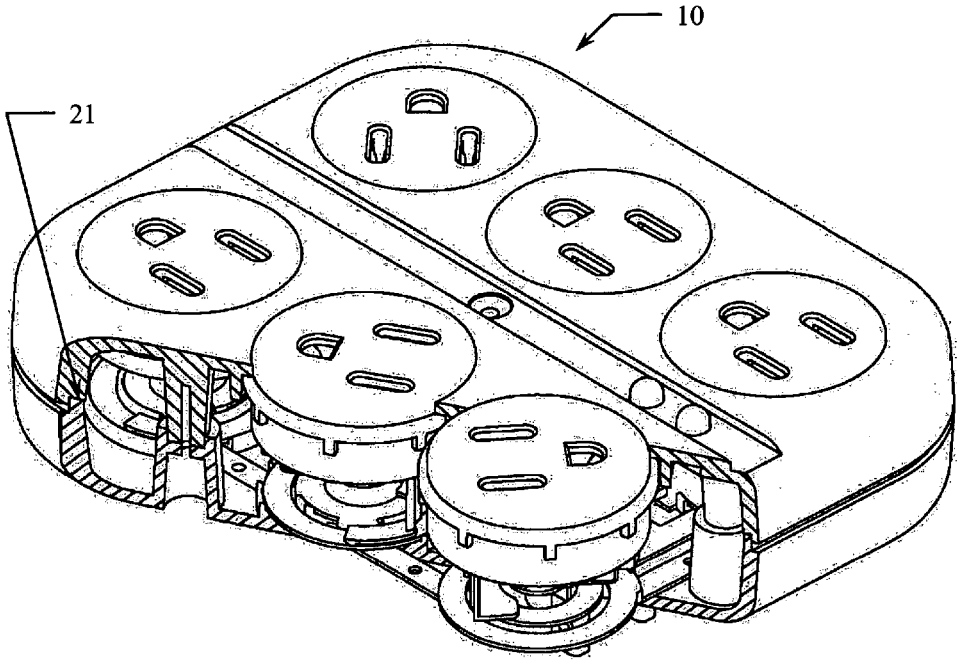
FIG. 3 is a substantially isometric view of the improved electrical power distribution apparatus, substantially similar to FIG. 1 except that a portion of the upper and lower housing of the improved electrical power distribution apparatus are shown as being cut away to reveal inner portions of the improved electrical power distribution apparatus. The upper and lower housing members are shown cross-hatched at their respective cut away areas.
Figure 4:
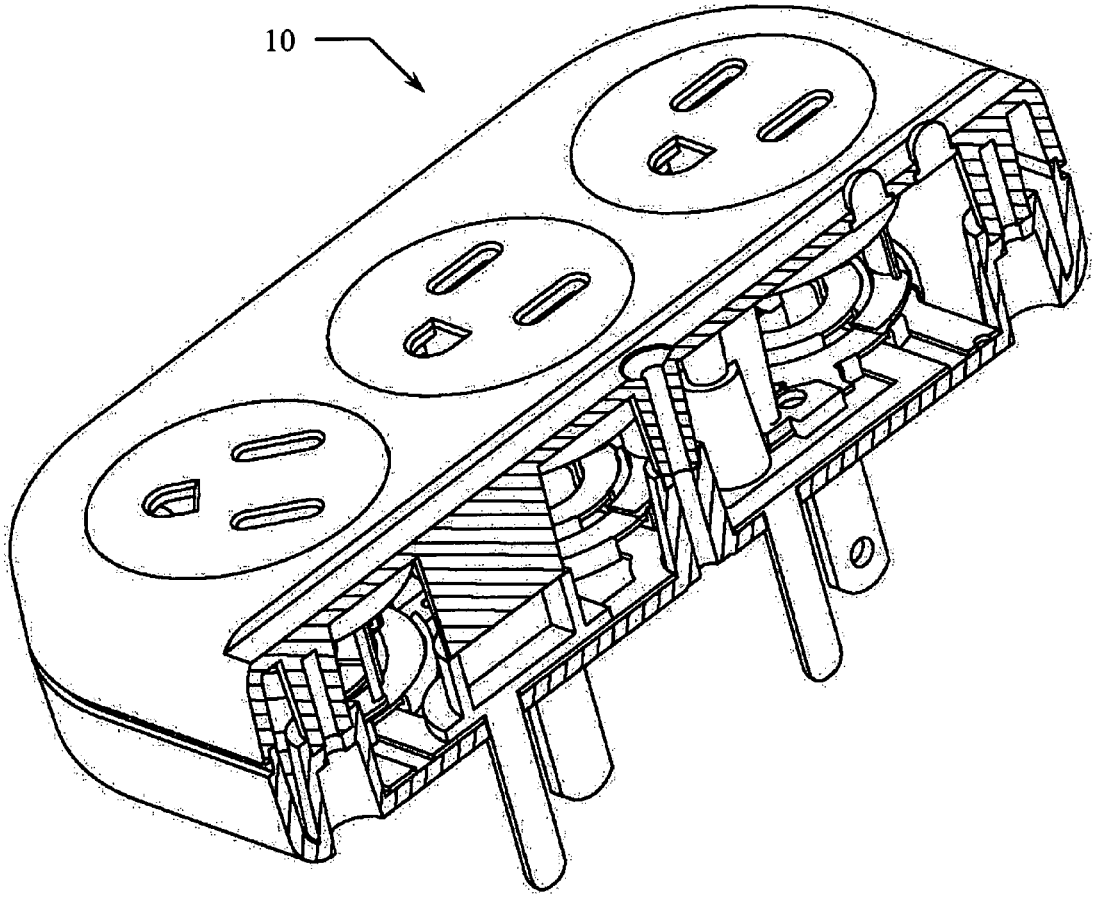
FIG. 4 is a random trimetric view of the improved electrical power distribution apparatus. The improved electrical power distribution apparatus is depicted as having the near side half of the improved electrical power distribution apparatus cut away to reveal inner portions of the improved electrical power distribution apparatus. The upper and lower housing members are shown cross-hatched at their respective cut away areas. For drawing clarity, other components of the improved electrical power distribution apparatus that are cut away are not shown as cross-hatched.

Upper housing 20 defines a substantially radiused cubic shaped shell having an upper housing interface recess 21 (FIG. 3), a plurality of cylindrically shaped upper housing female electrical connection device openings 22, an upper housing strap retention flange 23, an upper housing recessed channel 24, a plurality of cylindrically shaped upper housing indication light openings 25, and a plurality of cylindrically shaped upper housing fastener posts 26. Upper housing 20 is formed of plastic and may be of any plastic that provides adequate structural and insulative properties, and is compatible with injection molding or like plastic fabrication processes.

Lower housing 30 defines a substantially radiused cubic shaped shell having a lower housing interface flange 31, a plurality of cubic shaped lower housing electrical power supply prong openings 32, a plurality of cubic shaped lower housing electrical power return prong openings 33, a plurality of cylindrically shaped lower housing strap retention flanges 34, a plurality of cylindrically shaped lower housing fastener posts 35, a plurality of lower housing fastener post reception recesses 36, and a plurality of cylindrically shaped lower housing electrical ground prong openings 37. Each of the retention flanges 34 is adapted to have partial openings 112 and 114. The retention flanges 34 with partial openings 112 and 114 are designed in a manner so that the connection bar conductive element 74, of the ring shaped portions 73 (connection ring interface surface) and the connection bar conductive element 84 of the ring shaped portions 83 (connection ring interface surface) reside at different planar levels compared to each other. Lower housing 30 is formed of plastic and may be of any plastic that provides adequate structural and insulative properties, and is compatible with injection molding or like plastic fabrication processes.

Female electrical connection device body 41 defines a substantially cylindrically shaped body having a substantially cubic shaped power supply connection cavity 42, a substantially cubic shaped power return connection cavity 43, and a substantially cylindrically shaped ground connection cavity 44. Body 41 is formed of plastic and may be of any plastic that provides adequate structural and insulative properties, and is compatible with injection molding or like plastic fabrication processes.

Female electrical connection device power supply bracket 50 defines a formed substantially thin irregular shaped bracket having an upper connection surface 51, and a lower connection surface 52. Power supply bracket 50 is formed from a sheet of brass or like electrically conductive metal alloy.

Female electrical connection device power return bracket 54 defines a formed substantially thin irregular shaped bracket having an upper connection surface 55, and a lower connection surface 56. Power return bracket 54 is formed from a sheet of brass or like electrically conductive metal alloy.

Power supply strap 71 defines a formed substantially thin shaped strap having a connection bar 74 connected to a plurality of connection rings 72, said connection rings 72 each having a connection ring interface surface 73. Power supply strap 71 is formed from a sheet of brass or like electrically conductive metal alloy.

Power supply strap prong 75 defines a formed substantially thin elbow shaped prong having a prong interface surface 76. Power supply strap prong 75 is formed from a sheet of brass or like electrically conductive metal alloy.

Power return strap 81 defines a formed substantially thin shaped strap having a connection bar 84 connected to a plurality of connection rings 82, said connection rings 82 each having a connection ring interface surface 83. Power return strap 81 is formed from a sheet of brass or like electrically conductive metal alloy.

Power return strap prong 85 defines a formed substantially thin elbow shaped prong having a prong interface surface 86. Power return strap prong 85 is formed from a sheet of brass or like electrically conductive metal alloy.

Ground strap 90 defines a formed substantially thin strap having a plurality of connection pads 91, a plurality of connection pad interface surfaces 92, a plurality of connection bars 93, a connection prong 94, a connection prong interface surface 95, a mounting flange 96, a mounting flange hole 97, and a ground prong passage hole 98. Ground strap 90 is formed from a sheet of brass or like electrically conductive metal alloy.

Non-conductive male connection plug 100 defines a plug having a base 101, a seating flange 102, a simulated power supply prong 103, a simulated power return prong 104, and a simulated ground prong 105. Plug 100 is formed of plastic and may be of any plastic that provides adequate structural and insulative properties, and is compatible with injection molding or like plastic fabrication processes.

Indication light 110 defines a substantially small colored lightable light and may be for instance a light emitting diode type light.

Female electrical connection device 40 is assembled such that brackets 50, 54, and 60 are retentatively and electrical conductively fastened into cavities 42, 43, and 44 respectively. Power supply strap assembly 70 is assembled such that strap 71 is retentatively and electrical conductively fastened to prong 75. Power return strap assembly 80 is assembled such that strap 81 is retentatively and electrical conductively fastened to prong 85.

Improved electrical power distribution apparatus 10 is assembled such that ground strap 90, power return strap assembly 80, and power supply strap assembly 70 are nested into lower housing 30 and in particular, are nested between the plurality of lower housing strap retention flanges 34. Strap 90 and strap assemblies 80 and 70 are positioned such that each are electrically insulated from the other. Strap assembly 70 is further positioned such that power supply strap prong 75 passes through and protrudes from a power supply prong opening 32. Strap assembly 80 is further positioned such that power return strap prong 85 passes through and protrudes from a power return prong opening 33. Ground strap 90 is further positioned such that ground strap prong 94 passes through and protrudes from a ground prong opening 37. Non-conductive male connection plug 100 is positioned adjacent to ground strap 90 such that plug base 101 is in contact with ground strap connection bar 93, and such that plug prong 103 passes through and protrudes from a power supply prong opening 32, and such that plug prong 104 passes through and protrudes from a power return prong opening 33, and such that plug prong 105 passes through prong hole 98, and such that plug prong 105 passes through and protrudes from a ground prong opening 37. Female electrical connection devices 40 are snappingly engaged into upper housing 20 such that female electrical connection devices 40 are rotatably retained in upper housing openings 22, and positioned such that cavities 42, 43, and 44, are outwardly exposed through upper housing openings 22. Indication lights 110 are fastened to upper housing 20 such that lights 110 pass through and protrude from indication light openings 25. At least one of said indication lights 110 is electrically connected to strap assembly 70 and to strap assembly 80 such that when apparatus 10 is electrically powered, indication light 110 is lighted. With the members of improved electrical power distribution apparatus 10 assembled as described above, upper housing 20 is assembled to lower housing 30 such that upper housing fastener posts 26 engage with reception recesses 36 of lower housing posts 35, and such that male plug retention flange 23 is in retaining relationship to male connection plug 100, and such that power supply bracket lower connection surface 52 is in spring loaded electrically conductive contact with power supply strap connection ring interface surface 73, and such that power return bracket lower connection surface 56 is in spring loaded electrically conductive contact with power return strap connection ring interface surface 83, and such that ground bracket lower connection surface 62 is in spring loaded electrically conductive contact with ground strap connection pad interface surface 92. Upper housing 20 and lower housing 30 are secured together by means of threaded mechanical fasteners (not shown) such as those that are traditionally well known in the fastening art. Such fasteners are threaded through and secured into upper fastener posts 26 and lower fastener posts 35. Improved electrical power distribution apparatus 10 may be adapted such that non-conductive male connection plug 100 may float a small amount with apparatus 10 so as to compensate for a small amount of production manufacturing tolerance in corresponding wall power outlets.

In practice, with apparatus 10 assembled as described above, and protruding prongs 75, 85, and 94 functioning in combination as a standard male electrical connection plug, prongs 75, 85, and 94 of apparatus 10, are inserted into an energized standard wall mounted electrical outlet or the like such that an electrical connection is made between prong interface surfaces 76, 86, and 95 and corresponding electrical connecting surfaces of the wall mounted electrical outlet. Further, a male electrical connection plug of an electrical power consuming appliance is inserted into a female electrical connection device 40 such that upper connection surfaces 51, 55, and 61 are placed in electrical connection relationship with corresponding surfaces of said male electrical connection plug, and such that regardless of the rotational orientation of female electrical connection device 40, a completed electrical circuit is established, electrical power is distributed, and said appliance is electrically powered. Additionally, while said appliance is being powered, a rotation of female electrical connection device 40 will not interrupt said completed circuit. Because female electrical connection device 40 may be rotated while providing electrical power to said appliance, multiple appliances may be connected to apparatus 10 that would otherwise not be able to be connected to a conventional power distribution apparatus due to the non-rotatable power connection nature of female electrical connection devices of conventional power distribution apparatuses.

In an alternated embodiment, prongs 75, 85, and 94 of apparatus 10 are replaced with a conventional extension chord having a standard male electrical connection plug.

In another alternated embodiment, male connection plug 100 is replaced by a second instance of prongs 75, 85, and 94, with prongs 75, 85, and 94 being electrically connected to straps 71, 81, and 90 respectively, such that apparatus 10 includes two functional male type outlet plugs.

In yet another alternate embodiment, apparatus 10 includes a ground fault circuit interruption means or short circuit prevention means.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

I claim:

1. An electrical power distribution apparatus comprising a non-electrically conductive substantially rigid housing comprising an upper housing shell joined to a lower housing shell, at least one first electrical connection device, a plurality of second electrical connection device comprising a substantially cylindrically shaped non-electrically conductive body defining a first electrical power connection cavity, a second electrical power connection cavity, and a ground electrical connection cavity, wherein each of said cavities include an electrically conductive bracket connected to said cavity, an electrically conductive member, wherein said first electrical connection device and said second electrical connection device are electrically connected to said electrically conductive member and wherein said first electrical connection device and said electrically conductive member are joined to said housing and said electrically conductive member comprises a substantially elongated and substantially flat first conductive member defining a first substantially ring-shaped portion having a first arcuate interface surface, and a substantially elongated and substantially flat second conductive member defining a second substantially ring-shaped portion having a second arcuate interface surface, wherein said first ring-shaped portion of said first electrically conductive member and said second ring-shaped portion of said second electrically conductive member form a set of concentric circles disposed under the bottom of said body of said second electrical connection device and disposed adjacent to the bottom of said lower housing shell, wherein the first ring-shaped portion of said first electrically conductive member and said second ring-shaped portion of said second electrically conductive member are nested between a plurality of electrically non-conductive retention flanges substantially rigidly attached to the lower housing shell, wherein at least one of the plurality of electrically non-conductive retention flanges has a partial opening to accommodate a conductive element, the conductive element connected to one of the first ring-shaped portion and the second ring-shaped portion, and wherein further, said second electrical connection device is substantially rotatably joined to said housing such that when a closed electrical circuit is created by said first electrical connection device being connected to an electrical source and said second electrical connection device being connected to an electricity using appliance, said apparatus supplies electricity to said appliance regardless of the rotational orientation of said second electrical connection device to said housing.

2. The apparatus of claim 1 wherein said first electrical connection device is substantially rigidly joined to said housing.

3. The apparatus of claim 1 wherein said first electrical connection device defines a male plug type electrical connection device.

4. The apparatus of claim 1 wherein said second electrical connection device defines a rotatable female plug type electrical outlet connection device.

5. The apparatus of claim 1 wherein said apparatus includes at least one light electrically connected to said electrically conductive member and mounted to said housing such that when electricity flows through said electrically conductive member, said light is lighted.

6. The apparatus of claim 1 wherein first and second electrical connection prongs extend from said electrically conductive member through said lower housing shell.

7. The apparatus of claim 6 wherein a third electrical connection prong extends from said electrically conductive member through said lower housing shell and the combination of said first, second and third electrical connection prongs forms a three prong male plug.

8. The apparatus of claim 1 wherein one electrically conductive bracket is in spring loaded connection with said first arcuate interface surface and maintains an electrical connection with said first arcuate interface surface when said second electrical connection device is rotated rubbing against said first arcuate interface surface when said second electrical connection device is rotated.

9. The apparatus of claim 1 wherein said first conductive member defines an electrical power supply member, and said second conductive member defines an electrical power return member.

10. The apparatus of claim 1 wherein at least one of the first ring-shaped portion and the second ring-shaped portion are at different planar levels.

11. An electrical power distribution apparatus comprising a non-electrically conductive substantially rigid housing comprising an upper housing shell joined to a lower housing shell, at least one male plug type electrical connection device joined to said housing, a plurality of female plug type electrical connection devices each comprising a substantially cylindrical-shaped non-conductive body defining a first electrical power connection cavity, a second electrical power connection cavity, and a ground electrical connection cavity, wherein each of said cavities include an electrically conductive bracket connected to said cavity, and an electrically conductive member, wherein said male plug type electrical connection device and said conductive brackets of said female plug type electrical connection devices are electrically connected to said electrically conductive member and wherein said electrically conductive member comprises a substantially elongated and substantially flat first conductive member defining a plurality of first substantially ring-shaped portions each having a first arcuate interface surface, and a substantially elongated and substantially flat second conductive member defining a plurality of second substantially ring-shaped portions each having a second arcuate interface surface, wherein further the first ring-shaped portions are disposed in relation, to the second ring-shaped portions so as to form a plurality of sets of concentric circles each set comprised of one first ring-shaped portion and one second ring-shaped portion and wherein one set of concentric circles is disposed under the bottom of said body of each of said female plug type electrical connection devices and disposed adjacent to the bottom of said lower housing shell, and wherein further said female plug type electrical connection devices are substantially rotatably joined to said housing such that when a closed electrical circuit is created by said male plug type electrical connection device being connected to an electrical source and at least one of said female plug type electrical connection devices being connected to an electricity using appliance, said apparatus supplies electricity to said appliance regardless of the rotational orientation of said female plug type electrical connection device to said housing, and wherein said plurality of female plug type electrical connection devices are positioned in said housing in a grid type pattern defining at least two rows of female plug type electrical connection devices and at least two columns of female plug type electrical connection devices, wherein the first ring-shaped portion of said first electrically conductive member and said second ring-shaped portion of said second electrically conductive member are nested between a plurality of electrically non-conductive concentric retention flanges substantially rigidly attached to the lower housing shell, and wherein at least one of the plurality of electrically non-conductive retention flanges has a partial opening to accommodate a conductive element, the conductive element connected to one of the first ring-shaped portion and the second ring-shaped portion.

12. The apparatus of claim 11 wherein said apparatus includes at least one light electrically connected to said electrically conductive member and mounted to said housing such that when electricity flows through said electrically conductive member, said light is lighted, and wherein said plurality of female plug type electrical connection devices defines at least five female plug type electrical connection devices.

13. The apparatus of claim 11 wherein three electrical connection prongs extend from said electrically conductive member and through said lower housing shell.

14. The apparatus of claim 11 wherein one electrically conductive bracket in each female plug type electrical connection device is in spring loaded connection with one of said first arcuate interface surfaces and maintains an electrical connection with said first arcuate interface surface when said female plug type electrical connection device is rotated by rubbing against said first arcuate interface surface when said female plug type electrical connection device is rotated.

15. The apparatus of claim 14 wherein said first electrically conductive member defines an electrical power supply member, and said second conductive member defines an electrical power return member.

16. The apparatus of claim 11 wherein at least one of the first ring-shaped portion and the second ring-shaped portion are at different planar levels.

17. An electrical power distribution apparatus comprising:

a non-conductive housing;

a male plug attached to said housing;

a rotatable female-type electrical outlet disposed in the top of the housing and comprising a substantially cylindrical-shaped non-conductive body defining at least one electrical power connection cavity and an electrically conductive bracket connected to said cavity;

an electrically conductive member disposed inside the housing, and connected to said male plug and to said conductive bracket of said rotatable outlet, wherein said electrically conductive member comprises inner and outer conductive rings disposed adjacent to the bottom of said housing and disposed in concentric circles below the body of the rotatable outlet such that when the rotatable outlet is rotated 360 degrees and an electrical connection between the male plug and the rotatable outlet is unbroken, wherein the inner and outer conductive rings are nested between a plurality of electrically non-conductive retention flanges substantially rigidly attached to the bottom of said housing; and wherein at least one of the plurality of electrically non-conductive retention flanges has a partial opening to accommodate a conductive element, the conductive element connected to one of the inner conductive ring and the outer conductive ring.

18. The apparatus of claim 17 wherein at least one of the inner conductive ring and the outer conductive ring are at different planar levels.

* * * * *